US008815488B2

(12) United States Patent
Ashizawa

(10) Patent No.: US 8,815,488 B2
(45) Date of Patent: Aug. 26, 2014

(54) METHOD FOR PRODUCING TONER

(71) Applicant: Kao Corporation, Chuo-ku (JP)

(72) Inventor: Takeshi Ashizawa, Wakayama (JP)

(73) Assignee: Kao Corporation, Chuo-ku (JP)

( * ) Notice: Subject to any disclaimer, the term of this patent is extended or adjusted under 35 U.S.C. 154(b) by 28 days.

(21) Appl. No.: 13/672,919

(22) Filed: Nov. 9, 2012

(65) Prior Publication Data

US 2013/0130173 A1 May 23, 2013

(30) Foreign Application Priority Data

Nov. 18, 2011 (JP) ..... 2011-252947

(51) Int. Cl.
*G03G 9/087* (2006.01)
*G03G 9/08* (2006.01)

(52) U.S. Cl.
CPC ..... *G03G 9/08755* (2013.01); *G03G 9/08782* (2013.01); *G03G 9/08797* (2013.01); *G03G 9/081* (2013.01)
USPC ..... 430/137.18; 430/137.2

(58) Field of Classification Search
CPC ..... G03G 9/081
USPC ..... 430/137.18, 137.19, 137.2
See application file for complete search history.

(56) References Cited

U.S. PATENT DOCUMENTS 5,723,246 A * 3/1998 Aoki et al. ..... 430/109.4
6,756,172 B2 6/2004 Ueno et al.
6,936,393 B2 8/2005 Kubo et al.
6,946,228 B2 9/2005 Kanamaru et al.
2003/0104301 A1 6/2003 Ueno et al.
2003/0109668 A1 6/2003 Kubo et al.
2004/0185364 A1 9/2004 Kanamaru et al.
2007/0134582 A1* 6/2007 Moriya ..... 430/109.3
2007/0141498 A1* 6/2007 Umehara ..... 430/108.21
2008/0124636 A1* 5/2008 Yamaguchi et al. ..... 430/48

FOREIGN PATENT DOCUMENTS

JP 2000-275908 A 10/2000
JP 2003-119351 A 4/2003
JP 2003-231744 A 8/2003
JP 2004-198862 * 7/2004 ..... G03G 9/08
JP 2006-308764 A 11/2006
JP 2009-157202 A 7/2009

OTHER PUBLICATIONS

Translation of JP 2004-198862 published Jul. 2004.*

* cited by examiner

*Primary Examiner* — Peter Vajda
(74) *Attorney, Agent, or Firm* — Oblon, Spivak, McClelland, Maier & Neustadt, L.L.P.

(57) ABSTRACT

A method for producing a toner including the step of melt-kneading a mixture containing a resin binder and a wax with a twin-screw kneader, wherein the resin binder contains three kinds of a resin R1, a resin R2 and a resin R3 having different softening points to each other, wherein the wax contains at least two kinds of a wax W2 and a wax W3 having different melting points to each other, wherein the softening points of R1, R2 and R3 and the melting point W2 meet certain relationships, and wherein the mixture is supplied to the twin-screw kneader in an amount of from 1.3 to 5.0 kg/hr·cm$^2$ per unit cross-sectional area of the screw. The toner obtainable by the method of the present invention can be suitably used in, for example, the development or the like of latent image formed in electrophotography, an electrostatic recording method, an electrostatic printing method, or the like.

19 Claims, 1 Drawing Sheet

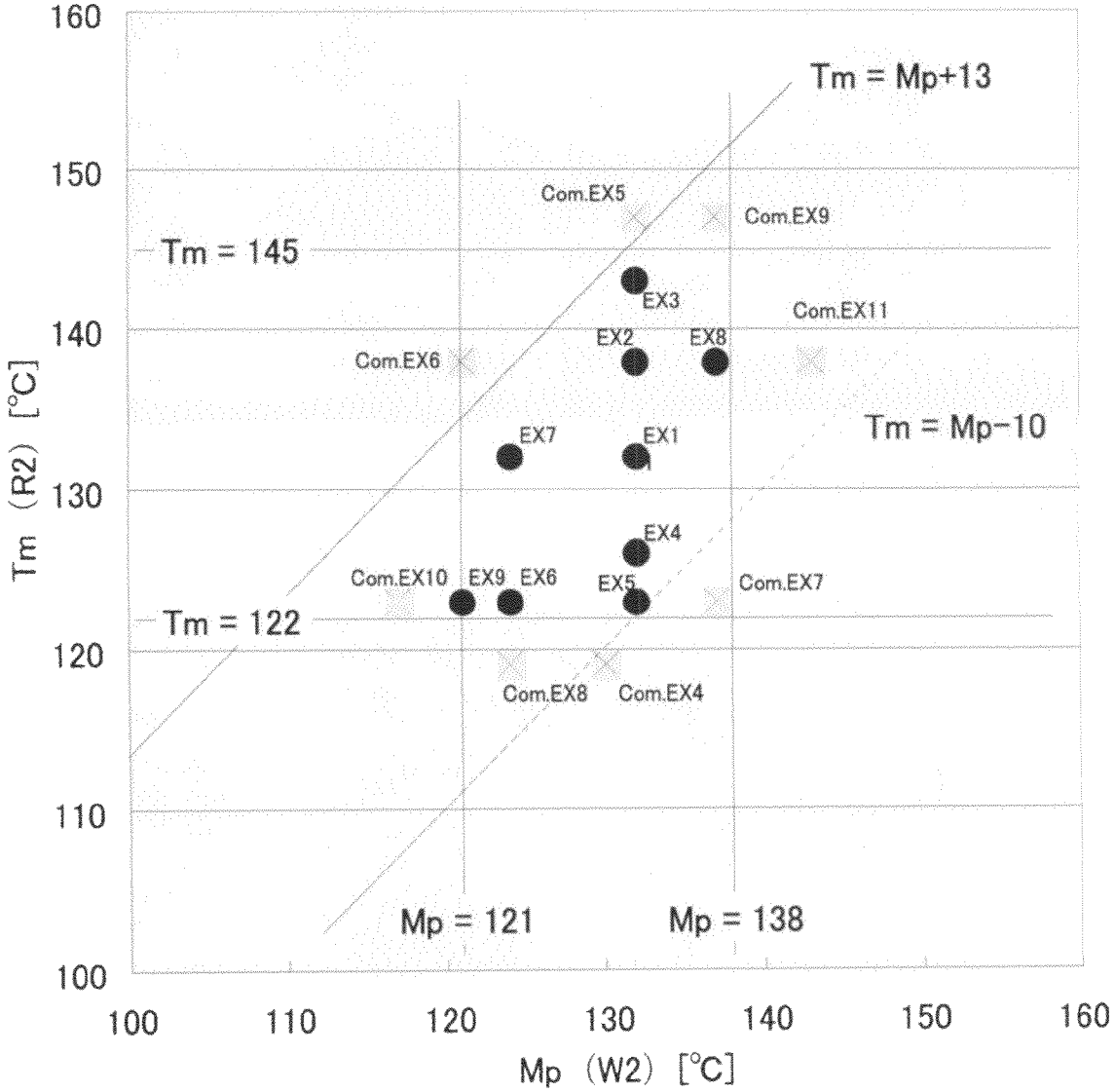
Tm = Mp+13
Tm = Mp−10
Tm = 145
Tm = 122
Mp = 138
Mp = 121
Com.EX5
Com.EX9
Com.EX11
Com.EX6
Com.EX10
Com.EX7
Com.EX8
Com.EX4
EX3
EX8
EX2
EX1
EX7
EX4
EX5
EX6
EX9
Tm (R2) [°C]
Mp (W2) [°C]
100
110
120
130
140
150
160

METHOD FOR PRODUCING TONER

FIELD OF THE INVENTION

The present invention relates to a method for producing a toner, which is used in, for example, the development of a latent image formed in electrophotography, electrostatic recording method, electrostatic printing method or the like.

BACKGROUND OF THE INVENTION

In the recent years, toners with improvements in low-temperature fixing ability are in great demands, from the viewpoint of reduction in consumed energy in a fixing step, in addition to the furtherance of miniaturization of an apparatus for electrophotography, speeding-up, high-image quality formation and the like. In order to meet such a demand, it is proposed to use resin binders containing a mixture of two or more kinds of resins, and a low-melting point wax (see, JP-A-2000-275908).

Also, a toner containing three kinds of polyester resins of which softening points are different by 5° C. or more having favorable fixing ability, and being excellent in high-temperature offset resistance, durability and storage property (see, Japanese JP-A-2009-157202), and a toner containing two kinds of resins having different softening points and a low-melting point biodegradable resin being excellent in all of low-temperature fixing ability, storage stability, offset resistance, environmental stability, reduction in environmental loads, fluidity, and pulverizability (see, JP-A-2006-308764) are proposed.

In addition, JP-A-2000-275908 and JP-A-2006-308764 disclose that a resin binder having a high softening point and a low-melting point wax or a low-melting point biodegradable resin are homogeneously dispersed by using a resin having a low-softening point.

SUMMARY OF THE INVENTION

The present invention relates to a method for producing a toner including the step of melt-kneading a mixture containing a resin binder and a wax with a twin-screw kneader, wherein the resin binder contains three kinds of a resin R1, a resin R2 and a resin R3 having different softening points to each other, wherein the resin R1 has a softening point Tm (R1) of from 145° to 160° C., the resin R2 has a softening point Tm (R2) of 122° C. or higher and lower than 145° C., and the resin R3 has a softening point Tm (R3) of 90° C. or higher and lower than 122° C., wherein the wax contains at least two kinds of a wax W2 and a wax W3 having different melting points to each other, wherein the wax W2 has a melting point Mp (W2) of from 121° to 138° C., and the wax W3 has a melting point Mp (W3) of from 70° to 95° C., wherein Tm (R1), Tm (R2), Tm (R3) and Mp (W2) satisfy the formulas (1) to (3):

$$Tm(R1)-Tm(R2)>5 \quad (1)$$

$$Tm(R2)-Tm(R3)>20 \quad (2)$$

$$Mp(W2)+13>Tm(R2)>Mp(W2)-10 \quad (3)$$

and wherein the mixture is supplied to the twin-screw kneader in an amount of from 1.3 to 5.0 kg/hr·cm$^2$ per unit cross-sectional area of the screw.

DETAILED DESCRIPTION OF THE INVENTION

The present inventors have found some disadvantages in the conventional methods that in the production of a toner containing a high-softening point resin, a low-softening point resin and a low-melting point wax for improving low-temperature fixing ability, if feeding rates of toner raw materials to a kneader are increased in a melt-kneading step, resins and a releasing agent cannot be homogeneously dispersed, so that productivity cannot be improved.

The present invention relates to a method capable of producing a toner containing a small amount of fine powder, with increasing raw material feeding rates to a kneader to shorten a mixing time, in other words, a time period for the melt-kneading step, thereby improving productivity, during melt-kneading of toner raw materials such as resins and waxes.

According to the method of the present invention, a toner containing a small amount of fine powder can be obtained, with increasing raw material feeding rates to a kneader to shorten a mixing time, thereby improving productivity, during melt-kneading of toner raw materials such as resins and waxes.

These and other advantages of the present invention will be apparent from the following description.

The method of the present invention is a method for producing a toner including the step of melt-kneading a mixture containing a resin binder containing three kinds of a resin R1, a resin R2 and a resin R3 having specified softening points, and a wax containing at least two kinds of waxes having different melting points with a twin-screw kneader, and the method has a feature in that the softening points of each of the resins and the melting points of each of the waxes satisfy specified relationships. According to the method of the present invention, some effects such as productivity of the toner is improved and a toner containing a small amount of fine powder is obtained are exhibited.

The detailed reasons why the effects of the present invention are exhibited are not elucidated. Although not wanting to be limited by theory, it is considered that in the production of a toner containing a high-softening point resin, a low-softening point resin and a low-melting point wax for improving low-temperature fixing ability, a third resin having an intermediate softening point is mixed therewith, so that miscibility of the resins having different softening points themselves is firstly improved, and further a wax having a melting point near a softening point of the resin having an intermediate softening point is used, whereby compatibility of both the resins and waxes are improved, thereby improving compatibility of the low-melting point wax with the resins, which in turn also improves the dispersibility of these waxes in the resins. In view of the above, it is deduced that when the mixture is melt-kneaded with a twin-screw extruder or the like, raw material supplying rates to a kneader can be increased to a level higher than that of the ordinary level, and the imbalance in particle sizes and compositions among the pulverized particles are controlled, so that formation of coarse particles or fine powders is suppressed, thereby improving productivity.

[Resin Binder]

The resin binder contains three kinds of a resin R1, a resin R2 and a resin R3 having different softening points to each other. It is preferable that the three kinds of the resin R1, the resin R2 and the resin R3 are amorphous resins, from the viewpoint of improving low-temperature fixing ability of the toner, from the viewpoint of improving high-temperature offset resistance of the toner, and from the viewpoint of reducing the amount of fine powders of the toner.

The resin R1 has a softening point Tm (R1) of 145° C. or higher, and preferably 148° C. or higher, from the viewpoint of improving high-temperature offset resistance of the toner and from the viewpoint of reducing the amount of fine powders of the toner. In addition, the resin R1 has a softening point Tm (R1) of 160° C. or lower, preferably 158° C. or lower, and more preferably 152° C. or lower, from the viewpoint of improving low-temperature fixing ability of the toner and from the viewpoint of reducing the amount of fine powders of the toner. In other words, from these viewpoints taken together, the resin R1 has a softening point Tm (R1) of from 145° to 160° C., preferably from 148° to 158° C., and more preferably from 148° to 152° C.

The resin R1 has a glass transition temperature of preferably 50° C. or higher, and more preferably 55° C. or higher, from the viewpoint of improving high-temperature offset resistance of the toner and from the viewpoint of reducing the amount of fine powders of the toner. In addition, the resin R1 has a glass transition temperature of preferably 80° C. or lower, and more preferably 75° C. or lower, from the viewpoint of improving low-temperature fixing ability of the toner and from the viewpoint of reducing the amount of fine powders of the toner. In other words, from these viewpoints taken together, the resin R1 has a glass transition temperature of preferably from 50° to 80° C., and more preferably from 55° to 75° C. The glass transition temperature is a physical property peculiarly owned by an amorphous resin.

The resin R2 has a softening point Tm (R2) that is lower than a softening point Tm (R1) of the resin R1, and that is higher than a softening point Tm (R3) of the resin R3, and the resin R2 has a softening point Tm (R2) of 122° C. or higher, preferably 123° C. or higher, and more preferably 125° C. or higher, from the viewpoint of improving high-temperature offset resistance of the toner and from the viewpoint of reducing the amount of fine powders of the toner. In addition, the resin R2 has a softening point Tm (R2) of lower than 145° C., preferably 143° C. or lower, and more preferably 140° C. or lower, from the viewpoint of improving low-temperature fixing ability of the toner and from the viewpoint of reducing the amount of fine powders of the toner. In other words, from these viewpoints taken together, the resin R2 has a softening point Tm (R2) of 122° C. or higher and lower than 145° C., preferably from 123° to 143° C., more preferably from 125° to 140° C., and even more preferably from 129° to 135° C.

The resin R2 has a glass transition temperature of preferably 40° C. or higher, and more preferably 50° C. or higher, from the viewpoint of improving high-temperature offset resistance of the toner and from the viewpoint of reducing the amount of fine powders of the toner. In addition, the resin R2 has a glass transition temperature of preferably 75° C. or lower, and more preferably 65° C. or lower, from the viewpoint of improving low-temperature fixing ability of the toner and from the viewpoint of reducing the amount of fine powders of the toner. In other words, from these viewpoints taken together, the resin R2 has a glass transition temperature of preferably from 40° to 75° C., and more preferably from 50° to 65° C.

The resin R3 has a softening point Tm (R3) that is lower than a softening point Tm (R2) of the resin R2, and the resin R3 has a softening point Tm (R3) of 90° C. or higher, and preferably 95° C. or higher, from the viewpoint of improving high-temperature offset resistance of the toner and from the viewpoint of reducing the amount of fine powders of the toner. In addition, the resin R3 has a softening point Tm (R3) of lower than 122° C., and preferably 115° C. or lower, from the viewpoint of improving low-temperature fixing ability of the toner and from the viewpoint of reducing the amount of fine powders of the toner. In other words, from these viewpoints taken together, the resin R2 has a softening point Tm (R2) of 90° C. or higher and lower than 122° C., and preferably from 95° to 115° C.

The resin R3 has a glass transition temperature of preferably 40° C. or higher, and more preferably 50° C. or higher, from the viewpoint of improving high-temperature offset resistance of the toner and from the viewpoint of reducing the amount of fine powders of the toner. In addition, the resin R3 has a glass transition temperature of preferably 70° C. or lower, and more preferably 65° C. or lower, from the viewpoint of improving low-temperature fixing ability of the toner and from the viewpoint of reducing the amount of fine powders of the toner. In other words, from these viewpoints taken together, the resin R3 has a glass transition temperature of preferably from 40° to 70° C., and more preferably from 50° to 65° C.

It is preferable that the resin binder used in the present invention is a polyester, from the viewpoint of improving low-temperature fixing ability of the toner. The polyester is contained in an amount of preferably 80% by weight or more, and more preferably 90% by weight or more, of the resin binder, and it is even more preferable that the resin binder consists of a polyester. However, a resin other than the polyester may be contained within the range that would not impair the effect of reducing the amount of fine powders. Other resin binders include vinyl resins, epoxy resins, polycarbonates, polyurethanes, and the like.

It is preferable that all of the three kinds of the resins having different softening points, i.e. the resin R1, the resin R2 and the resin R3, are amorphous polyesters. It is more preferable that all of the three kinds of the resins are amorphous polyester obtained by polycondensing an alcohol component containing a dihydric or higher polyhydric alcohol and a carboxylic acid component containing a dicarboxylic or higher polycarboxylic acid compound.

Here, the crystallinity of the resin is expressed by a crystallinity index defined by a value of a ratio of a softening point to a temperature of maximum endothermic peak determined by a scanning differential calorimeter, i.e. softening point/temperature of maximum endothermic peak. The crystalline resin is a resin having a crystallinity index of from 0.6 to 1.4, preferably from 0.7 to 1.2, and more preferably from 0.9 to 1.2, and the amorphous resin is a resin having a crystallinity index exceeding 1.4 or less than 0.6. The crystallinity of the resin can be adjusted by the kinds of the raw material monomers, a ratio thereof, production conditions, e.g. reaction temperature, reaction time, cooling rate, and the like. Here, the temperature of maximum endothermic peak refers to a temperature of the peak on the highest temperature side among endothermic peaks observed. When a difference between the temperature of maximum endothermic peak and the softening point is within 20° C., the temperature of maximum endothermic peak is defined as a melting point. When the difference between the temperature of maximum endothermic peak and the softening point exceeds 20° C., the peak is a peak temperature ascribed to a glass transition.

The resin R1 has a temperature of maximum endothermic peak of preferably 50° C. or higher, and more preferably 60° C. or higher, from the viewpoint of improving high-temperature offset resistance of the toner and from the viewpoint of reducing the amount of fine powders of the toner. In addition, the resin R1 has a temperature of maximum endothermic peak of preferably 80° C. or lower, and more preferably 75° C. or lower, from the viewpoint of improving low-temperature fixing ability of the toner and from the viewpoint of reducing the amount of fine powders of the toner. In other words, from these viewpoints taken together, the resin R1 has a temperature of maximum endothermic peak of preferably from 50° to 80° C., and more preferably from 60° to 75° C.

The resin R2 has a temperature of maximum endothermic peak of preferably 45° C. or higher, and more preferably 60° C. or higher, from the viewpoint of improving high-temperature offset resistance of the toner and from the viewpoint of reducing the amount of fine powders of the toner. In addition, the resin R2 has a temperature of maximum endothermic peak of preferably 80° C. or lower, and more preferably 70° C. or lower, from the viewpoint of improving low-temperature fixing ability of the toner and from the viewpoint of reducing the amount of fine powders of the toner. In other words, from these viewpoints taken together, the resin R2 has a temperature of maximum endothermic peak of preferably from 45° to 80° C., and more preferably from 60° to 70° C.

The resin R3 has a temperature of maximum endothermic peak of preferably 40° C. or higher, and more preferably 55° C. or higher, from the viewpoint of improving high-temperature offset resistance of the toner and from the viewpoint of reducing the amount of fine powders of the toner. In addition, the resin R3 has a temperature of maximum endothermic peak of preferably 80° C. or lower, and more preferably 70° C. or lower, from the viewpoint of improving low-temperature fixing ability of the toner and from the viewpoint of reducing the amount of fine powders of the toner. In other words, from these viewpoints taken together, the resin R3 has a temperature of maximum endothermic peak of preferably from 40° to 80° C., and more preferably from 55° to 70° C.

The dihydric alcohol includes diols having 2 to 20 carbon atoms, and preferably 2 to 15 carbon atoms, and an alkylene oxide adduct of bisphenol A, represented by the formula (I):

(I)

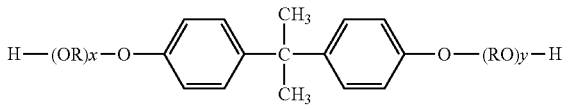

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4. Specific examples of the dihydric alcohol having 2 to 20 carbon atoms include ethylene glycol, propylene glycol, 1,4-butanediol, 1,6-hexanediol, bisphenol A, hydrogenated bisphenol A and the like.

As the alcohol component, the alkylene oxide adduct of bisphenol A represented by the formula (I) is preferred, from the viewpoint of improving high-temperature offset resistance of the toner and from the viewpoint of reducing the amount of fine powders of the toner. The alkylene oxide adduct of bisphenol A represented by the formula (I) is contained in an amount of preferably 50% by mol or more, more preferably 70% by mol or more, even more preferably 90% by mol or more, and still even more preferably substantially 100% by mol, of the alcohol component.

The trihydric or higher polyhydric alcohol includes trihydric or higher polyhydric alcohols having 3 to 20 carbon atoms, and preferably 3 to 10 carbon atoms. Specific examples thereof include sorbitol, 1,4-sorbitan, pentaerythritol, glycerol, trimethylolpropane, and the like.

The dicarboxylic acid compound, for example, includes dicarboxylic acid having 3 to 30 carbon atoms, preferably 3 to 20 carbon atoms, and more preferably 3 to 10 carbon atoms, derivatives such as acid anhydrides thereof, alkyl(1 to 8 carbon atoms) ester thereof, and the like. Specific examples include aromatic dicarboxylic acids such as phthalic acid, isophthalic acid, and terephthalic acid, and aliphatic dicarboxylic acids, such as fumaric acid, maleic acid, succinic acid, glutaric acid, adipic acid, sebacic acid, and succinic acids substituted with an alkyl group having 1 to 20 carbon atoms or an alkenyl group having 2 to 20 carbon atoms.

The tricarboxylic or higher polycarboxylic acid compound, for example, includes tricarboxylic or higher polycarboxylic acids having 4 to 30 carbon atoms, preferably 4 to 20 carbon atoms, and more preferably 4 to 10 carbon atoms, derivatives such as acid anhydrides thereof, alkyl(1 to 8 carbon atoms) ester thereof, and the like. Specific examples include 1,2,4-benzenetricarboxylic acid, i.e. trimellitic acid, 1,2,4,5-benzenetetracarboxylic acid, i.e. pyromellitic acid, and acid anhydrides thereof, and the like.

Here, the alcohol component may properly contain a monohydric alcohol, and the carboxylic acid component may properly contain a monocarboxylic acid compound, from the viewpoint of adjusting the softening point of the polyester.

The carboxylic acid component and the alcohol component in the polyester are in an equivalent ratio, i.e. COOH group or groups/OH group or groups, of preferably from 0.70 to 1.10, and more preferably from 0.75 to 1.00, from the viewpoint of reducing an acid value of the polyester.

The polycondensation reaction of the alcohol component and the carboxylic acid component can be carried out by polycondensing the components in an inert gas atmosphere at a temperature of from 180° to 250° C. or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component and the carboxylic acid component. The polymerization inhibitor is used in an amount of preferably from 0.001 to 0.5 parts by weight, and more preferably from 0.01 to 0.1 parts by weight, based on 100 parts by weight of a total amount of the alcohol component and the carboxylic acid component.

Each of the three kinds of the polyesters having a different softening point to each other can be obtained by polycondensing the alcohol component and the carboxylic acid component mentioned above in the same manner except for adjusting the softening point. The method of adjusting a softening point includes, for example, a method of adjusting a molecular weight by a reaction time. If the reaction time is made longer, the softening point is likely to be higher, and if the reaction time is made shorter, the softening point is likely to be lower.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in JP-A-Hei-11-133668, JP-A-Hei-10-239903, JP-A-Hei-8-20636, or the like.

The amount of the resin R1 is preferably from 10 to 50% by weight, more preferably from 20 to 40% by weight, even more preferably from 20 to 30% by weight, and still even more preferably from 20 to 25% by weight, of the resin binder, from the viewpoint of improving high-temperature offset resistance of the toner and from the viewpoint of reducing the amount of fine powders of the toner. Here, the word "amount" simply used herein includes both the content and the amount blended.

The amount of the resin R2 is preferably from 5 to 50% by weight, more preferably from 15 to 45% by weight, even more preferably from 25 to 40% by weight, still even more preferably from 25 to 35% by weight, and still even more preferably from 25 to 30% by weight, of the resin binder, from the viewpoint of reducing the amount of fine powders of the toner.

The amount of the resin R3 is preferably from 20 to 80% by weight, more preferably from 30 to 70% by weight, even more preferably from 50 to 60% by weight, and still even more preferably from 50 to 55% by weight, of the resin binder, from the viewpoint of improving low-temperature fixing ability of the toner and from the viewpoint of reducing the amount of fine powders of the toner.

The resin R1 and the resin R2 are in a weight ratio, i.e. resin R1/resin R2, of preferably from 15/85 to 90/10, more preferably from 20/80 to 80/20, even more preferably from 30/70 to 75/25, still even more preferably from 35/65 to 60/40, and still even more preferably from 40/60 to 55/45, from the viewpoint of improving high-temperature offset resistance of the toner and from the viewpoint of reducing the amount of fine powders of the toner.

The resin R2 and the resin R3 are in a weight ratio, i.e. resin R2/resin R3, of preferably from 5/95 to 80/20, more preferably from 15/85 to 60/40, even more preferably from 30/70 to 55/45, still even more preferably from 32/68 to 55/45, and still even more preferably from 32/68 to 50/50, from the viewpoint of improving low-temperature fixing ability of the toner and from the viewpoint of reducing the amount of fine powders of the toner.

The resin R1 and the resin R3 are in a weight ratio, i.e. resin R1/resin R3, of preferably from 1/99 to 90/10, more preferably from 5/95 to 70/30, even more preferably from 15/85 to 60/40, still even more preferably from 25/75 to 50/50, and still even more preferably from 30/70 to 43/57, from the viewpoint of improving low-temperature fixing ability of the toner, from the viewpoint of improving high-temperature offset resistance of the toner, and from the viewpoint of reducing the amount of fine powders of the toner.

A total amount of the resin R1 and the resin R3 and the resin R2 are in a weight ratio, i.e. [resin R1+resin R3]/resin R2, of preferably from 40/60 to 90/10, more preferably from 50/50 to 80/20, even more preferably from 55/45 to 75/25, and still even more preferably from 70/30 to 75/25, from the viewpoint of improving low-temperature fixing ability of the toner, from the viewpoint of improving high-temperature offset resistance of the toner, and from the viewpoint of reducing the amount of fine powders of the toner.

[Wax]

The wax contains at least two kinds of waxes, a wax W2 and a wax W3, having different melting points to each other.

The wax W2 has a melting point Mp (W2) of 121° C. or higher, and preferably 123° C. or higher, from the viewpoint of improving high-temperature offset resistance of the toner and from the viewpoint of reducing the amount of fine powders of the toner. In addition, the wax W2 has a melting point Mp (W2) of 138° C. or lower, preferably 137° C. or lower, and more preferably 135° C. or lower, from the viewpoint of improving low-temperature fixing ability of the toner and from the viewpoint of reducing the amount of fine powders of the toner. In other words, from these viewpoints taken together, the wax W2 has a melting point Mp (W2) of from 121° to 138° C., preferably from 121° to 137° C., and more preferably from 123° to 135° C.

The wax W3 has a melting point Mp (W3) of 70° C. or higher, and preferably 73° C. or higher, from the viewpoint of improving high-temperature offset resistance of the toner and from the viewpoint of reducing the amount of fine powders of the toner. In addition, the wax W3 has a melting point Mp (W3) of 95° C. or lower, and preferably 85° C. or lower, from the viewpoint of improving low-temperature fixing ability of the toner and from the viewpoint of reducing the amount of fine powders of the toner. In other words, from these viewpoints taken together, the wax W3 has a melting point Mp (W3) of from 70° to 95° C., and preferably from 73° to 85° C.

The waxes W2 and W3 may be any of those of which melting points fall under the range mentioned above, and include aliphatic hydrocarbon waxes such as polypropylenes, polyethylenes, polypropylene-polyethylene copolymers, microcrystalline waxes, paraffinic waxes, and Fischer-Tropsch wax, and oxides thereof; ester waxes such as carnauba wax, montan wax, and sazole wax, deacidified waxes thereof; fatty acid amides, fatty acids, higher alcohols, metal salts of fatty acids, and the like. The wax may contain two or more kinds of them in a mixture. The wax W2 is preferably a polypropylene wax, and the wax W3 is preferably a paraffinic wax and a carnauba wax.

The amount of the wax W2 is preferably from 0.1 to 10 parts by weight, more preferably from 0.2 to 5.0 parts by weight, even more preferably from 0.3 to 1.5 parts by weight, and still even more preferably from 0.4 to 1.0 part by weight, based on 100 parts by weight of the resin binder, from the viewpoint of improving high-temperature offset resistance of the toner, and from the viewpoint of reducing the amount of fine powders of the toner.

The amount of the wax W3 is preferably from 0.5 to 10 parts by weight, more preferably from 1.0 to 5.0 parts by weight, even more preferably from 1.0 to 3.0 parts by weight, and still even more preferably from 1.2 to 2.0 parts by weight, based on 100 parts by weight of the resin binder, from the viewpoint of improving low-temperature fixing ability of the toner, from the viewpoint of improving high-temperature offset resistance of the toner, and from the viewpoint of reducing the amount of fine powders of the toner.

The wax W2 and the wax W3 are in a weight ratio, i.e. wax W2/wax W3, of preferably from 5/95 to 60/40, more preferably from 10/90 to 55/45, even more preferably from 15/85 to 50/50, and still even more preferably from 20/80 to 40/60, and still even more preferably from 20/80 to 30/70, from the viewpoint of improving high-temperature offset resistance of the toner, from the viewpoint of improving low-temperature fixing ability of the toner, and from the viewpoint of reducing the amount of fine powders of the toner.

A total content of the wax W2 and the wax W3 is preferably from 0.6 to 15 parts by weight, more preferably from 1.0 to 10 parts by weight, even more preferably from 1.5 to 6.0 parts by weight, and still even more preferably from 1.5 to 2.5 parts by weight, based on 100 parts by weight of the resin binder, from the viewpoint of improving high-temperature offset resistance of the toner, from the viewpoint of improving low-temperature fixing ability of the toner, and from the viewpoint of reducing the amount of fine powders of the toner.

Further, in addition to the wax W2 and the wax W3 mentioned above, the wax may contain a wax W1 having a melting point exceeding 138° C. within the range that would not impair the effects of reducing fine powders. The wax W1 has a melting point of preferably exceeding 138° C. and 150° C. or lower, and more preferably from 140° to 145° C. The wax W1 is preferably a fatty acid amide wax.

The amount of the wax W1 is preferably 10 parts by weight or less, and more preferably 5.0 parts by weight or less, based on 100 parts by weight of the resin binder, from the viewpoint of reducing the amount of fine powders of the toner.

A total amount of the wax W1, the wax W2 and the W3 is preferably from 0.6 to 15 parts by weight, more preferably from 1.0 to 10 parts by weight, even more preferably from 1.5 to 6.0 parts by weight, and still even more preferably from 1.5 to 2.5 parts by weight, based on 100 parts by weight of the resin binder, from the viewpoint of improving high-temperature offset resistance of the toner, from the viewpoint of improving low-temperature fixing ability of the toner, and from the viewpoint of reducing the amount of fine powders of the toner.

[Relational Formulas]

The softening points Tm (R1), Tm (R2) and Tm (R3) of the resins R1 to R3 satisfy the formulas (1) and (2):

$$Tm(R1)-Tm(R2)>5 \quad (1), \text{ and}$$

$$Tm(R2)-Tm(R3)>20 \quad (2),$$

from the viewpoint of reducing the amount of fine powders of the toner. By satisfying the above relationships, the miscibility of the resin R1 and the resin R3 in the melt-kneading step is even more improved by the resin R2.

In addition, the softening point Tm (R2) of the resin R2 and the melting point Mp (W2) of the wax W2 satisfy the formula (3):

$$Mp(W2)+13>Tm(R2)>Mp(W2)-10 \quad (3),$$

from the viewpoint of reducing the amount of fine powders of the toner. The formula (3) is preferably:

$$Mp(W2)+13>Tm(R2)>Mp(W2)-8, \text{ and}$$

more preferably:

$$Mp(W2)+10>Tm(R2)>Mp(W2)-8.$$

By satisfying the above relation, the compatibility between the resin R2 and the wax W2 is improved, thereby improving dispersibility of the wax W2 and the wax W3 in a resin binder containing a resin R1, a resin R2 and a resin R3.

Further, it is preferable that Mp (W2) and Mp (W3) satisfy the formula (4):

$$Mp(W2)-Mp(W3)>40 \quad (4),$$

from the viewpoint of improving high-temperature and low-temperature offset resistance of the toner, from the viewpoint of improving image quality durability of the toner, and from the viewpoint of reducing the amount of fine powders of the toner, more preferably:

$$Mp(W2)-Mp(W3)>45,$$

even more preferably:

$$Mp(W2)-Mp(W3)>50, \text{ and}$$

still even more preferably:

$$Mp(W2)-Mp(W3)>55.$$

The toner obtainable according to the method of the present invention may further contain a colorant, a charge control agent and the like.

[Colorant]

In the present invention, as the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The toner of the present invention may be any of black toners and color toners. It is preferable that the method of the present invention is used in the production of black toners which are needed in large production amounts, from the viewpoint of enabling high productivity. It is preferable that the carbon blacks are used as the colorant, from the same viewpoint. The colorant is contained in an amount of preferably from 1 to 40 parts by weight, and more preferably from 2 to 10 parts by weight, based on 100 parts by weight of the resin binder.

[Charge Control Agent]

As the charge control agent, any of negatively chargeable charge control agents and positively chargeable charge control agents can be used.

The negatively chargeable charge control agent includes metal-containing azo dyes, copper phthalocyanine dyes, metal complexes of alkyl derivatives of salicylic acid, nitroimidazole derivatives, boron complexes of benzilic acid, and the like. The metal-containing azo dyes include, for example, "VARIFAST BLACK 3804," "BONTRON S-28," "BONTRON S-31," "BONTRON S-32," "BONTRON S-34," "BONTRON S-36," hereinabove commercially available from Orient Chemical Industries Co., Ltd.; "T-77," "AIZEN SPILON BLACK TRH," hereinabove commercially available from Hodogaya Chemical Co., Ltd., and the like. The metal complexes of alkyl derivatives of salicylic acid include, for example, "BONTRON E-81," "BONTRON E-82," "BONTRON E-84," "BONTRON E-85," hereinabove commercially available from Orient Chemical Industries Co., Ltd., and the like. The boron complexes of benzilic acid include, for example, "LR-147" commercially available from Japan Carlit Co., Ltd., and the like.

The positively chargeable charge control agent includes Nigrosine dyes, triphenylmethane-based dyes, quaternary ammonium salt compounds, polyamine resins, imidazole derivatives, and the like. The Nigrosine dyes include, for example, "Nigrosine Base EX," "Oil Black BS," "Oil Black SO," "BONTRON N-01," "BONTRON N-07," "BONTRON N-09," "BONTRON N-11," hereinabove commercially available from Orient Chemical Industries Co., Ltd., and the like. The triphenylmethane-based dyes include, for example, triphenylmethane-based dyes containing a tertiary amine as a side chain. The quaternary ammonium salt compounds include, for example, "BONTRON P-51," "BONTRON P-52," hereinabove commercially available from Orient Chemical Industries Co., Ltd.; "TP-415" commercially available from Hodogaya Chemical Co., Ltd.; cetyltrimethylammonium bromide, "COPY CHARGE PX VP435," "COPY CHARGE PSY," hereinabove commercially available from Clariant GmbH, and the like. The polyamine resins include, for example, "AFP-B" commercially available from Orient Chemical Industries Co., Ltd., and the like. The imidazole derivatives include, for example, "PLZ-2001," "PLZ-8001" hereinabove commercially available from Shikoku Chemicals Corporation, and the like.

The charge control agent is contained in an amount of preferably from 0.2 to 5 parts by weight, based on 100 parts by weight of the resin binder, from the viewpoint of improving triboelectric stability of the toner.

In the present invention, an additive such as a magnetic powder, a fluidity improver, an electric conductivity modifier, an extender, a reinforcing filler such as a fibrous substance, an antioxidant, an anti-aging agent or a cleanability improver may be properly used as materials for toners.

<Method for Producing Toner>

The method of the present invention includes the step of melt-kneading a mixture containing a resin binder and a wax with a twin-screw kneader, wherein the mixture is supplied to the twin-screw kneader in an amount of from 1.3 to 5.0 kg/hr·cm$^2$ per unit cross-sectional area of the screw. It is preferable that the method further comprises, subsequent to the melt-kneading step, a pulverization step and a classification step.

It is preferable that raw materials for toners containing a resin binder and a wax are previously mixed with a mixer such as a Henschel mixer or a ball-mill, and the mixture is then supplied to the kneader.

The twin-screw kneader refers to a closed-type kneader in which two kneading screws are covered with barrel, and it is preferable that the twin-screw kneader is a type of which screws can be rotated in the same direction of the screw rotations, from the viewpoint of improving dispersibility of the colorant or the charge control agent in the resin binder. As commercially available products, twin-screw extruders, PCM Series commercially available from IKEGAI Corporation, which have excellent engagement of the two screws at high speeds, are preferred, from the viewpoint of improving productivity.

The mixture is supplied to the twin-screw kneader in an amount of 1.3 kg/hr·cm$^2$ or more, preferably 1.5 kg/hr·cm$^2$ or more, and more preferably 2.0 kg/hr·cm$^2$ or more, per unit cross-sectional area of the screw, from the viewpoint of improving productivity. In addition, the mixture is supplied to the twin-screw kneader in an amount of 5.0 kg/hr·cm$^2$ or less, preferably 4.5 kg/hr·cm$^2$ or less, and more preferably 4.0 kg/hr·cm$^2$ or less, per unit cross-sectional area of the screw, from the viewpoint of improving dispersibility of the colorant and the charge control agent in the resin binder, and from the viewpoint of reducing the amount of fine powders of the toner. Specifically, from these viewpoints taken together, the mixture is supplied to the twin-screw kneader in an amount of from 1.3 to 5.0 kg/hr·cm$^2$, preferably from 1.5 to 4.5 kg/hr·cm$^2$, and more preferably from 2.0 to 4.0 kg/hr·cm$^2$.

The melt-kneading with the twin-screw kneader is carried out by adjusting a barrel setting temperature, i.e. a temperature of an internal wall side of the kneader, a peripheral speed of the screw rotation of the twin screws, and supplying rates of raw materials. The barrel setting temperature is preferably from 80° to 140° C., and more preferably from 90° to 120° C., from the viewpoint of improving dispersibility of the colorant and the charge control agent in the resin binder, and from the viewpoint of improving productivity.

The peripheral speed of the screw rotation of the twin screws is preferably from 0.1 to 1 m/sec, from the viewpoint of improving dispersibility of the colorant and the charge control agent in the resin binder, and from the viewpoint of improving productivity.

The resin kneaded mixture obtained is cooled to an extent that is pulverizable, and the cooled mixture is pulverized and classified.

The pulverization step may be carried out separately in multi-stages. For example, the resin kneaded mixture may be roughly pulverized to a size of from 1 to 5 mm or so, and the roughly pulverized product may be further finely pulverized. In addition, in order to improve productivity during the pulverization step and the classification step, a resin kneaded mixture may be pulverized after mixing the resin kneaded mixture with fine inorganic particles made of a hydrophobic silica or the like.

The pulverizer used in the pulverization step is not particularly limited. For example, the pulverizer preferably used in the rough pulverization includes an atomizer, Rotoplex, and the like, or a hammer-mill or the like may be used. In addition, and the pulverizer preferably used in the fine pulverization includes fluidised bed opposed jet mill, an impact type mill, a mechanical mill, and the like.

The classifier used in the classification step includes an air classifier, a rotor type classifier, a sieve classifier, and the like. The pulverized product which is insufficiently pulverized and removed during the classifying step may be subjected to the pulverization step again, and the pulverization step and the classification step may be repeated as occasion demands.

The toner particles obtained in the classification step have a volume-median particle size $D_{50}$ of preferably from 3 to 15 μm, and more preferably from 4 to 12 μm, from the viewpoint of improving the image quality of the toner. The term "volume-median particle size $D_{50}$" as used herein means a particle size of which cumulative volume frequency calculated on a volume percentage is 50% counted from the smaller particle sizes.

The toner in the present invention may be obtained by a method including the step of further mixing toner particles obtained after the pulverization step and the classification step as the toner matrix particles, with an external additive such as fine inorganic particles made of silica or the like, or fine resin particles made of polytetrafluoroethylene or the like.

In the mixing of a pulverized product or the toner particles obtained after a classification step with an external additive, an agitator having an agitating member such as rotary blades is preferably used, and a more preferred agitator includes a Henschel mixer.

The toner obtainable by the method of the present invention has the feature that the toner contains a small amount of fine powders. In the present invention, the amount of fine powders is expressed as a content of the particles having particle sizes of 3 μm or less in the finely pulverized product, and when the amount of fine powders is 45% by number or less, it is referred to as "contains or containing a small amount of fine powders." The smaller the amount of the fine powders, the more preferred, and the amount of fine powders is more preferably 38% by number or less. A smaller amount of fine powders shows that dispersibility of a wax, a colorant, a charge control agent or the like in a resin binder is improved, and the smaller amount of fine powders is preferred, from the viewpoint of capable of efficiently carrying out a classification step after the fine pulverization, thereby improving the productivity.

The toner obtained by the method of the present invention can be directly used as a toner for monocomponent development, or can be used as a toner mixed with a carrier for two-component development, in an apparatus for forming fixed images of a monocomponent development or a two-component development.

Regarding the embodiments mentioned above, the present invention will further disclose the following production methods or use thereof.

<1> A method for producing a toner including the step of melt-kneading a mixture containing a resin binder and a wax with a twin-screw kneader, wherein the resin binder contains three kinds of a resin R1, a resin R2 and a resin R3 having different softening points to each other, wherein the resin R1 has a softening point Tm (R1) of from 145° to 160° C., the resin R2 has a softening point Tm (R2) of 122° C. or higher and lower than 145° C., and the resin R3 has a softening point Tm (R3) of 90° C. or higher and lower than 122° C., wherein the wax contains at least two kinds of a wax W2 and a wax W3 having different melting points to each other, wherein the wax W2 has a melting point Mp (W2) of from 121° to 138° C., and the wax W3 has a melting point Mp (W3) of from 70° to 95° C., wherein Tm (R1), Tm (R2), Tm (R3) and Mp (W2) satisfy the formulas (1) to (3):

$$Tm(R1)-Tm(R2)>5 \quad (1),$$

$$Tm(R2)-Tm(R3)>20 \quad (2), \text{ and}$$

$$Mp(W2)+13>Tm(R2)>Mp(W2)-10 \quad (3),$$

and wherein the mixture is supplied to the twin-screw kneader in an amount of from 1.3 to 5.0 kg/hr·cm$^2$ per unit cross-sectional area of the screw.

<2> The method for producing a toner according to the above <1>, wherein Mp (W2) and Mp (W3) satisfy the formula (4):

$$Mp(W2)-Mp(W3)>40, \quad (4)$$

more preferably satisfying:

$$Mp(W2)-Mp(W3)>45,$$

even more preferably satisfying:

$$Mp(W2)-Mp(W3)>50,$$

and still even more preferably satisfying:

$$Mp(W2)-Mp(W3)>55.$$

<3> The method for producing a toner according to the above <1> or <2>, wherein each of the resin R1, the resin R2 and the resin R3 is an amorphous polyester.

<4> The method for producing a toner according to any one of the above <1> to <3>, wherein the resin R2 has a softening point Tm (R2) of preferably 123° C. or higher, more preferably 125° C. or higher, preferably 143° C. or lower, more preferably 140° C. or lower, preferably from 123° to 143° C., more preferably from 125° to 140° C., and even more preferably from 129° to 135° C.

<5> The method for producing a toner according to any one of the above <1> to <4>, wherein the wax W2 has a melting point Mp (W2) of preferably 123° C. or higher, preferably 137° C. or lower, more preferably 135° C. or lower, preferably from 121° to 137° C., and more preferably from 123° to 135° C.

<6> The method for producing a toner according to any one of the above <1> to <5>, wherein the softening point Tm (R2) of the resin R2 and the melting point Mp (W2) of the wax W2 preferably satisfy:

$$Mp(W2)+13>Tm(R2)>Mp(W2)-8,$$

and more preferably satisfying:

$$Mp(W2)+10>Tm(R2)>Mp(W2)-8.$$

<7> The method for producing a toner according to any one of the above <1> to <6>, wherein the resin R1 and the resin R2 are in a weight ratio, i.e. the resin R1/the resin R2, of from 15/85 to 90/10, more preferably from 20/80 to 80/20, even more preferably from 30/70 to 75/25, still even more preferably from 35/65 to 60/40, and still even more preferably from 40/60 to 55/45.

<8> The method for producing a toner according to any one of the above <1> to <7>, wherein the resin R2 and the resin R3 are in a weight ratio, i.e. the resin R2/the resin R3, of from 5/95 to 80/20, more preferably from 15/85 to 60/40, even more preferably from 30/70 to 55/45, still even more preferably from 32/68 to 55/45, and still even more preferably from 32/68 to 50/50.

<9> The method for producing a toner according to any one of the above <1> to <8>, wherein the resin R1 and the resin R3 are in a weight ratio, i.e. the resin R1/the resin R3, of from 1/99 to 90/10, more preferably from 5/95 to 70/30, even more preferably from 15/85 to 60/40, still even more preferably from 25/75 to 50/50, and still even more preferably from 30/70 to 43/57.

<10> The method for producing a toner according to any one of the above <1> to <9>, wherein a total amount of the resin R1 and the resin R3 and the resin R2 are in a weight ratio, i.e. (the resin R1+the resin R3)/the resin R2, of from 40/60 to 90/10, more preferably from 50/50 to 80/20, even more preferably from 55/45 to 75/25, and still even more preferably from 70/30 to 75/25.

<11> The method for producing a toner according to any one of the above <1> to <10>, wherein the amount of the resin R2 is from 5 to 50% by weight, more preferably from 15 to 45% by weight, even more preferably from 25 to 40% by weight, still even more preferably from 25 to 35% by weight, and still even more preferably from 25 to 30% by weight, of the resin binder.

<12> The method for producing a toner according to any one of the above <1> to <11>, wherein the amount of the wax W2 is from 0.1 to 10 parts by weight, more preferably from 0.2 to 5.0 parts by weight, even more preferably from 0.3 to 1.5 parts by weight, and still even more preferably from 0.4 to 1.0 part by weight, based on 100 parts by weight of the resin binder.

<13> The method for producing a toner according to any one of the above <1> to <12>, wherein the wax W2 and the wax W3 are in a weight ratio, i.e. the wax W2/the wax W3, of from 5/95 to 60/40, more preferably from 10/90 to 55/45, even more preferably from 15/85 to 50/50, still even more preferably from 20/80 to 40/60, and still even more preferably from 20/80 to 30/70.

<14> The method for producing a toner according to any one of the above <1> to <13>, wherein the resin R3 has a softening point Tm (R3) of preferably 95° C. or higher, preferably 115° C. or lower, and preferably from 95° to 115° C.

<15> The method for producing a toner according to any one of the above <1> to <14>, wherein the resin R1 has a softening point Tm (R1) of preferably 148° C. or higher, preferably 158° C. or lower, more preferably 152° C. or lower, and preferably from 148° to 158° C., and more preferably from 148° to 152° C.

<16> The method for producing a toner according to any one of the above <1> to <15>, wherein the wax W3 has a melting point Mp (W3) of preferably 73° C. or higher, preferably 85° C. or lower, and preferably from 73° to 85° C.

<17> The method for producing a toner according to any one of the above <1> to <16>, wherein the toner contains a wax W1 having a melting point of exceeding 138° C. and 150° C. or lower, and preferably from 140° to 145° C.

<18> The method for producing a toner according to any one of the above <3> to <17>, wherein the amorphous polyester is obtained by polycondensing an alcohol component containing a dihydric or higher polyhydric alcohol and a carboxylic acid component containing a dicarboxylic or higher polycarboxylic acid compound, wherein the alcohol component contains an alkylene oxide adduct of bisphenol A represented by the formula (I) in an amount of preferably 50% by mol or more, more preferably 70% by mol or more, even more preferably 90% by mol or more, and still even more preferably substantially 100% by mol, of the alcohol component.

<19> The method for producing a toner according to any one of the above <1> to <18>, wherein the resin R1 has a glass transition temperature of from 50° to 80° C., more preferably 55° C. or higher, more preferably 75° C. or lower, and more preferably from 55° to 75° C.

<20> The method for producing a toner according to any one of the above <1> to <19>, wherein the resin R2 has a glass transition temperature of from 40° to 75° C., more preferably 50° C. or higher, more preferably 65° C. or lower, and more preferably from 50° to 65° C.

<21> The method for producing a toner according to any one of the above <1> to <20>, wherein the resin R3 has a glass transition temperature of from 40° to 70° C., more preferably 50° C. or higher, more preferably 65° C. or lower, and more preferably from 50° to 65° C.

<22> The method for producing a toner according to any one of the above <1> to <21>, wherein the resin R1 has a temperature of maximum endothermic peak of from 50° to 80° C., more preferably 60° C. or higher, more preferably 75° C. or lower, and more preferably from 60° to 75° C.

<23> The method for producing a toner according to any one of the above <1> to <22>, wherein the resin R2 has a temperature of maximum endothermic peak of from 45° to 80° C., more preferably 60° C. or higher, more preferably 70° C. or lower, and more preferably from 60° to 70° C.

<24> The method for producing a toner according to any one of the above <1> to <23>, wherein the resin R3 has a temperature of maximum endothermic peak of from 40° to 80° C., more preferably 55° C. or higher, more preferably 70° C. or lower, and more preferably from 55° to 70° C.

<25> The method for producing a toner according to any one of the above <1> to <24>, wherein the amount of the resin R1 is from 10 to 50% by weight, more preferably from 20 to 40% by weight, even more preferably from 20 to 30% by weight, and still even more preferably from 20 to 25% by weight, of the resin binder.

<26> The method for producing a toner according to any one of the above <1> to <25>, wherein the amount of the resin R3 is from 20 to 80% by weight, more preferably from 30 to 70% by weight, even more preferably from 50 to 60% by weight, and still even more preferably from 50 to 55% by weight, of the resin binder.

<27> The method for producing a toner according to any one of the above <1> to <26>, wherein the amount of the wax W3 is from 0.5 to 10 parts by weight, more preferably from 1.0 to 5.0 parts by weight, even more preferably from 1.0 to 3.0 parts by weight, and still even more preferably from 1.2 to 2.0 parts by weight, based on 100 parts by weight of the resin binder.

<28> The method for producing a toner according to any one of the above <1> to <27>, wherein a total content of the wax W2 and the wax W3 is from 0.6 to 15 parts by weight, more preferably from 1.0 to 10 parts by weight, even more preferably from 1.5 to 6.0 parts by weight, and still even more preferably from 1.5 to 2.5 parts by weight, based on 100 parts by weight of the resin binder.

<29> The method for producing a toner according to any one of the above <1> to <28>, wherein a total amount of the wax W1, the wax W2 and the wax W3 is from 0.6 to 15 parts by weight, more preferably from 1.0 to 10 parts by weight, even more preferably from 1.5 to 6.0 parts by weight, and still even more preferably from 1.5 to 2.5 parts by weight, based on 100 parts by weight of the resin binder.

<30> The method for producing a toner according to any one of the above <1> to <29>, wherein the mixture is supplied to the twin-screw kneader in an amount of preferably 1.5 kg/hr·cm$^2$ or more, and more preferably 2.0 kg/hr·cm$^2$ or more, preferably 4.5 kg/hr·cm$^2$ or less, and more preferably 4.0 kg/hr·cm$^2$ or less, and preferably from 1.5 to 4.5 kg/hr·cm$^2$, and more preferably from 2.0 to 4.0 kg/hr·cm$^2$, per unit cross-sectional area of the screw.

<31> The method for producing a toner according to any one of the above <1> to <30>, wherein in the step of melt-kneading the mixture with a twin-screw kneader, the barrel setting temperature is preferably from 80° to 140° C., and more preferably from 90° to 120° C.

<32> The method for producing a toner according to any one of the above <1> to <31>, wherein in the step of melt-kneading the mixture with a twin-screw kneader, the peripheral speed of screw rotation of the twin screws is preferably from 0.1 to 1 m/sec.

<33> The method for producing a toner according to any one of the above <1> to <32>, wherein the wax W2 is a polypropylene wax, and wherein the wax W3 is a paraffin wax or a carnauba wax.

<34> The method for producing a toner according to any one of the above <17> to <33>, wherein the wax W1 is a fatty acid amide wax.

<35> The method for producing a toner according to any one of the above <1> to <34>, wherein the toner is a black toner.

<36> The method for producing a toner according to the above <35>, wherein a colorant for the black toner is a carbon black.

<37> The method for producing a toner according to the above <36>, wherein the colorant is contained in an amount of preferably from 1 to 40 parts by weight, and more preferably from 2 to 10 parts by weight, based on 100 parts by weight of the resin binder.

<38> A toner for electrophotography obtainable by the method for producing a toner as defined in any one of the above <1> to <37>.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which half of the sample flows out, when plotting a downward movement of a plunger of a flow tester commercially available from Shimadzu Corporation, CAPILLARY RHEOMETER "CFT-500D", against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Temperature of Maximum Endothermic Peak of Resin]

Measurements were taken using a differential scanning calorimeter "Q-100," commercially available from TA Instruments, Japan, by cooling a 0.01 to 0.02 g sample weighed out in an aluminum pan from room temperature to 0° C. at a cooling rate of 10° C./min, allowing the cooled sample to stand for 1 minute, and thereafter heating the sample at a rate of 50° C./min. Among the endothermic peaks observed, the temperature of an endothermic peak on the highest temperature side is defined as a temperature of maximum endothermic peak.

[Glass Transition Temperature of Resin]

The glass transition temperature refers to a temperature of an intersection of the extension of the baseline of equal to or lower than the temperature of the maximum endothermic peak and the tangential line showing the maximum inclination between the kick-off of the peak and the top of the peak, which is obtained by heating a sample to 200° C., cooling the sample from that temperature to 0° C. at a cooling rate of 10° C./min, and thereafter raising the temperature of the sample at a heating rate of 10° C./min, using a differential scanning calorimeter commercially available from Seiko Instruments Inc., "DSC 210".

[Melting Point of Wax]

A temperature of maximum endothermic peak of the heat of fusion obtained by raising the temperature of a sample to 200° C., cooling the sample from this temperature to 0° C. at a cooling rate of 10° C./min, and thereafter raising the temperature of the sample at a heating rate of 10° C./min, using a differential scanning calorimeter commercially available from Seiko Instruments Inc. "DSC 210 is referred to as a melting point.

[Volume-Median Particle Size of Toner]

Measuring Apparatus: Coulter Multisizer II commercially available from Beckman Coulter, Inc.

Aperture Diameter: 100 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6 is dissolved in the above electrolytic solution so as to have a concentration of 5% by weight to provide a dispersion.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

Production Example 1 of Resins [Resins A and H]

A 5-liter four-neck flask equipped with a nitrogen inlet tube, a dehydration tube, a stirrer, and a thermocouple was charged with raw material monomers as listed in Table 1 other than trimellitic anhydride, and a polymerization inhibitor. The contents were reacted at 200° C. over 6 hours in a nitrogen atmosphere. Further, trimellitic anhydride was added to the reaction mixture at 210° C., and the components were reacted at a normal pressure of 101.3 kPa for 1 hour, and thereafter reacted at 40 kPa until a desired softening point was reached, to provide each of amorphous polyesters having the physical properties listed in Table 1.

Production Example 2 of Resins [Resins B, D, E, F, G, J, and K]

A 5-liter four-neck flask equipped with a nitrogen inlet tube, a dehydration tube, a stirrer, and a thermocouple was charged with raw material monomers as listed in Table 1 other than trimellitic anhydride, and a catalyst. The contents were reacted at 235° C. over 4 hours in a nitrogen atmosphere. Further, trimellitic anhydride was added to the reaction mixture at 210° C., and the components were reacted at a normal pressure of 101.3 kPa until a desired softening point was reached, to provide each of amorphous polyesters having the physical properties listed in Table 1.

Production Example 3 of Resins [Resins C and I]

A 5-liter four-neck flask equipped with a nitrogen inlet tube, a dehydration tube, a stirrer, and a thermocouple was charged with raw material monomers as listed in Table 1 and a catalyst. The contents were reacted at 230° C. over 3 hours in a nitrogen atmosphere. Thereafter, the reaction mixture was reacted under reduced pressure of 40 kPa, until a desired softening point was reached, to provide each of amorphous polyesters having the physical properties listed in Table 1.

TABLE 1

| | Resin A | Resin B | Resin C | Resin D | Resin E | Resin F | Resin G | Resin H | Resin I | Resin J | Resin K |
|---|---|---|---|---|---|---|---|---|---|---|---|
| Raw Material Monomers | | | | | | | | | | | |
| BPA-PO[1)] | 2304 g (90) | — | 694 g (24) | — | — | — | — | 2304 g (90) | 694 g (24) | — | — |
| BPA-EO[2)] | 238 g (10) | 2516 g (100) | 2041 g (76) | 2516 g (100) | 2516 g (100) | 2516 g (100) | 2516 g (100) | 238 g (10) | 2041 g (76) | 2516 g (100) | 2516 g (100) |
| Terephthalic Acid | — | 598 g (46.5) | 1196 g (100) | 598 g (46.5) | 598 g (46.5) | 598 g (46.5) | 598 g (46.5) | — | 1196 g (100) | 598 g (46.5) | 598 g (46.5) |
| Fumaric Acid | 484 g (77) | — | — | — | — | — | — | 484 g (77) | — | — | — |
| Trimellitic Anhydride | 431 g (23) | 327 g (22) | — | 327 g (22) | 327 g (22) | 327 g (22) | 327 g (22) | 431 g (23) | — | 327 g (22) | 327 g (22) |
| Dodecenylsuccinic Anhydride | — | 414 g (20) | — | 414 g (20) | 414 g (20) | 414 g (20) | 414 g (20) | — | — | 414 g (20) | 414 g (20) |
| Esterification Catalyst | | | | | | | | | | | |
| Tin (II) 2-Ethylhexanoate | — | 19.1 g | 19.6 g | 19.1 g | 19.1 g | 19.1 g | 19.1 g | — | 19.6 g | 19.1 g | 19.1 g |
| Polymerization Inhibitor | | | | | | | | | | | |
| t-Butylcatechol | 1.7 g | — | — | — | — | — | — | 1.7 g | — | — | — |
| Physical Properties of Resin | | | | | | | | | | | |
| Softening Point (° C.) | 150 | 132 | 99 | 123 | 147 | 138 | 126 | 157 | 111 | 143 | 119 |
| Temperature of Maximum Endothermic Peak (° C.) | 71 | 65 | 63 | 64 | 65 | 64 | 64 | 72 | 65 | 64 | 63 |
| Softening Point/Temperature of Maximum Endothermic Peak | 2.1 | 2.0 | 1.6 | 1.9 | 2.3 | 2.2 | 2.0 | 2.2 | 1.7 | 2.2 | 1.9 |
| Glass Transition Temperature (° C.) | 67 | 58 | 60 | 58 | 58 | 58 | 58 | 67 | 60 | 58 | 58 |

Note)

Numerical values inside the parenthesis are expressed by molar ratio supposing that a total number of moles of the alcohol component is 100.

[1)]BPA-PO: Polyoxypropylene(2.2)-2,2-bis(4-hydroxyphenyl)propane

[2)]BPA-EO: Polyoxyethylene(2.2)-2,2-bis(4-hydroxyphenyl)propane

The melting points of the waxes used in Examples and Comparative Examples are listed in Table 2.

TABLE 2

| | Chemical Name | Manufacturer and Trade Name | Melting Point (° C.) |
|---|---|---|---|
| Wax a | Polypropylene Wax | Commercially available from MITSUI CHEMICALS, INC., MITSUI HI WAX NP056 | 132 |
| Wax b | Paraffinic Wax | Commercially available from NIPPON SEIRO CO., LTD., HNP-9 | 75 |
| Wax c | Polypropylene Wax | Commercially available from MITSUI CHEMICALS, INC., MITSUI HI WAX NP056 | 121 |
| Wax d | Polypropylene Wax | Commercially available from MITSUI CHEMICALS, INC., MITSUI HI WAX NP056 | 124 |
| Wax e | Ester Wax | Commercially available from S. Kato & CO., Carnauba Wax | 89 |
| Wax f | Polypropylene Wax | Commercially available from MITSUI CHEMICALS, INC., MITSUI HI WAX NP056 | 130 |
| Wax g | Polypropylene Wax | Commercially available from MITSUI CHEMICALS, INC., MITSUI HI WAX NP055 | 137 |
| Wax h | Synthetic Paraffin Wax | Commercially available from S. Kato & CO., SP-105 | 117 |
| Wax i | Fatty Acid Amide Wax | Commercially available from Kao Corporation, KAO WAX EB-P | 143 |
| Wax j | Fatty Acid Amide Wax | Commercially available from Kao Corporation, KAO WAX EB-P | 145 |

Examples 1 to 19 and Comparative Examples 1 to 11

The resin binder and the wax listed in Table 3 or 4, 4.0 parts by weight of a carbon black "Regal 330" commercially available from Cabot Corporation, and 0.5 parts by weight of a charge control agent "T-77" commercially available from Hodogaya Chemical Co., Ltd. were mixed with a Henschel mixer. Thereafter, the mixture was melt-kneaded using a co-rotating twin-screw extruder PCM-30 commercially available from IKEGAI Corporation, a screw diameter: 2.9 cm, a cross-sectional area of screw: 7.06 $cm^2$, at a barrel setting temperature of 100° C., and a rotational speed of the screw of 200 r/min, i.e. peripheral speed of the screw rotations: 0.30 m/sec, under conditions that the mixture supplying rate of 10 kg/hr, i.e. a mixture supplying rate per unit cross-sectional area of the screw: 1.42 $kg/hr \cdot cm^2$, to provide a resin kneaded mixture.

The resin kneaded mixture obtained was cooled, and the cooled mixture was roughly pulverized with a pulverizer "Rotoplex" commercially available from Hosokawa Micron Corporation, to provide a roughly pulverized product having a volume particle size of 2 mm or less using a sieve having an opening of 2 mm. The roughly pulverized product obtained was subjected to fine pulverization with an air jet-type classifier Model DS2, commercially available from Nippon Pneumatic Mfg. Co., Ltd., while adjusting a pulverization pressure so as to have a volume-median particle size of 8.0 μm. The finely pulverized product was classified with an air jet-type classifier Model DSX2, commercially available from Nippon Pneumatic Mfg. Co., Ltd., so as to have a volume-median particle size of 8.5 μm while adjusting a static pressure, an internal pressure, to provide a toner.

Example 20

The melt-kneading was carried out under the same conditions as in Example 1 except that the mixture supplying rate was changed to 20 kg/hr, i.e. mixture supplying rate per unit cross-sectional area of the screw: 2.83 $kg/hr \cdot cm^2$, to provide a resin kneaded mixture.

The resin kneaded mixture obtained was roughly pulverized and finely pulverized, and subjected to a classification treatment in the same manner as in Example 1 to provide a toner.

Example 21

The melt-kneading was carried out under the same conditions as in Example 1 except that the mixture was melt-kneaded using a co-rotating twin-screw extruder PCM-45 commercially available from IKEGAI Corporation, a screw diameter: 4.4 cm, a cross-sectional area of screw: 15.9 $cm^2$, at a barrel setting temperature of 100° C. and a rotational speed of the screw of 200 r/min, i.e. a peripheral speed of the screw rotation: 0.46 m/sec, and the mixture supplying rate was changed to 50 kg/hr, i.e. a mixture supplying rate per unit cross-sectional area of the screw: 3.14 $kg/hr \cdot cm^2$, to provide a resin kneaded mixture.

The resin kneaded mixture obtained was roughly pulverized and finely pulverized, and subjected to a classification treatment in the same manner as in Example 1 to provide a toner.

Example 22

The melt-kneading was carried out under the same conditions as in Example 1 except that the mixture was melt-kneaded using a co-rotating twin-screw extruder PCM-63 commercially available from IKEGAI Corporation, a screw diameter: 6.2 cm, a cross-sectional area of screw: 31.2 $cm^2$, at a barrel setting temperature of 100° C. and a rotational speed of the screw of 200 r/min, i.e. a peripheral speed of the screw rotations: 0.65 m/sec, and the mixture supplying rate was changed to 120 kg/hr, i.e. a mixture supplying rate per unit cross-sectional area of the screw: 3.85 $kg/hr \cdot cm^2$, to provide a resin kneaded mixture.

The resin kneaded mixture obtained was roughly pulverized and finely pulverized, and subjected to a classification treatment in the same manner as in Example 1 to provide a toner.

Test Example

The content as expressed by the units of % by number of the particles having particle sizes of 3 μm or less in the finely pulverized mixture was measured in accordance with the following method.

Measuring Apparatus Coulter Multisizer III commercially available from Beckman Coulter, Inc.

Aperture Diameter: 100 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6 is dissolved in the above electrolytic solution so as to have a concentration of 5% by weight to provide a dispersion.

Dispersion Conditions: Ten milligrams of a finely pulverized mixture is added to 5 ml of the above dispersion, and the mixture is dispersed for 1 minute with an ultrasonic disperser, and 25 mL of the above electrolytic solution is added to the dispersion, and further dispersed with an ultrasonic disperser for 1 minute, to prepare a sample dispersion.

Measurement Conditions: The above sample dispersion is added to 100 mL of the above electrolytic solution to adjust to a concentration at which particle sizes of 30,000 particles can be measured in 20 seconds, and thereafter the 30,000 particles are measured, and the content as expressed in units of % by number of the particles having particles sizes of 3 μM or less is obtained from the particle size distribution. The smaller the numerical values, the smaller the amount of fine powders.

The content as expressed in units of % by number of the particles having particles sizes of 3 μm or less in a finely pulverized mixture was measured for each of the toners of Examples 1 to 22 and Comparative Examples 1 to 11. The results are shown in Tables 3 to 5.

TABLE 3

| | Resin Binder | | | Wax | | | Tm (R1) − Tm(R2) | Tm (R2) − Tm(R3) | Mp (W2) + 13 | Tm (R2) (° C.) | Mp (W2) − 10 | Content of Particles Having Particle Sizes of 3 μm or Less (% by number) |
|---|---|---|---|---|---|---|---|---|---|---|---|---|
| | Resin R1 | Resin R2 | Resin R3 | Wax W1 | Wax W2 | Wax W3 | | | | | | |
| Ex. 1 | Resin A(25) | Resin B(25) | Resin C(50) | — | Wax a(0.5) | Wax b(1.5) | 18 | 33 | 145 | 132 | 122 | 30.8 |
| Ex. 2 | Resin A(25) | Resin F(25) | Resin C(50) | — | Wax a(0.5) | Wax b(1.5) | 12 | 39 | 145 | 138 | 122 | 32.3 |
| Ex. 3 | Resin A(25) | Resin J(25) | Resin C(50) | — | Wax a(0.5) | Wax b(1.5) | 7 | 44 | 145 | 143 | 122 | 39.2 |
| Ex. 4 | Resin A(25) | Resin G(25) | Resin C(50) | — | Wax a(0.5) | Wax b(1.5) | 24 | 27 | 145 | 126 | 122 | 31.5 |
| Ex. 5 | Resin A(25) | Resin D(25) | Resin C(50) | — | Wax a(0.5) | Wax b(1.5) | 27 | 24 | 145 | 123 | 122 | 40.6 |
| Ex. 6 | Resin A(25) | Resin D(25) | Resin C(50) | — | Wax d(0.5) | Wax b(1.5) | 27 | 24 | 137 | 123 | 114 | 40.1 |
| Ex. 7 | Resin A(25) | Resin B(25) | Resin C(50) | — | Wax d(0.5) | Wax b(1.5) | 18 | 33 | 137 | 132 | 114 | 34.5 |
| Ex. 8 | Resin A(25) | Resin F(25) | Resin C(50) | — | Wax g(0.5) | Wax b(1.5) | 12 | 39 | 150 | 138 | 127 | 38.9 |
| Ex. 9 | Resin A(25) | Resin D(25) | Resin C(50) | — | Wax c(0.5) | Wax b(1.5) | 27 | 24 | 134 | 123 | 111 | 39.8 |
| Ex. 10 | Resin H(25) | Resin B(25) | Resin C(50) | — | Wax a(0.5) | Wax b(1.5) | 25 | 33 | 145 | 132 | 122 | 33.5 |
| Ex. 11 | Resin A(25) | Resin B(25) | Resin I(50) | — | Wax a(0.5) | Wax b(1.5) | 18 | 21 | 145 | 132 | 122 | 30.7 |
| Ex. 12 | Resin A(25) | Resin B(25) | Resin C(50) | — | Wax a(0.5) | Wax e(1.5) | 18 | 33 | 145 | 132 | 122 | 36.5 |
| Ex. 13 | Resin A(25) | Resin B(10) | Resin C(65) | — | Wax a(0.5) | Wax b(1.5) | 18 | 33 | 145 | 132 | 122 | 36.8 |
| Ex. 14 | Resin A(25) | Resin B(40) | Resin C(35) | — | Wax a(0.5) | Wax b(1.5) | 18 | 33 | 145 | 132 | 122 | 31.2 |
| Ex. 15 | Resin A(35) | Resin B(20) | Resin C(45) | — | Wax a(0.5) | Wax b(1.5) | 18 | 33 | 145 | 132 | 122 | 38.7 |
| Ex. 16 | Resin A(25) | Resin B(25) | Resin C(50) | — | Wax a(0.3) | Wax b(1.5) | 18 | 33 | 145 | 132 | 122 | 37.7 |
| Ex. 17 | Resin A(25) | Resin B(25) | Resin C(50) | — | Wax a(1.5) | Wax b(1.5) | 18 | 33 | 145 | 132 | 122 | 35.2 |
| Ex. 18 | Resin A(25) | Resin B(25) | Resin C(50) | — | Wax a(0.5) | Wax b(3.0) | 18 | 33 | 145 | 132 | 122 | 41.1 |
| Ex. 19 | Resin A(25) | Resin B(25) | Resin C(50) | Wax j(3.0) | Wax a(0.5) | Wax b(1.5) | 18 | 33 | 145 | 132 | 122 | 31.6 |

Note)

Numerical values inside the parentheses are expressed by parts by weight, based on 100 parts by weight of the resin binder.

TABLE 4

| | Resin Binder | | | Wax | | Tm(R1) − Tm(R2) | Tm(R2) − Tm(R3) | Mp(W2) + 13 | Tm(R2) (° C.) | Mp(W2) − 10 | Content of Particles Having Particle Sizes of 3 μm or Less (% by number) |
|---|---|---|---|---|---|---|---|---|---|---|---|
| | Resin R1 | Resin R2 | Resin R3 | Wax W2 | Wax W3 | | | | | | |
| Comp. Ex. 1 | Resin A(50) | — | Resin C(50) | — | Wax b(1.5) | — | — | — | — | — | 61.6 |
| Comp. Ex. 2 | Resin A(25) | Resin B(25) | Resin C(50) | — | Wax b(1.5) | 18 | 33 | — | 132 | — | 56.2 |
| Comp. Ex. 3 | Resin A(50) | — | Resin C(50) | Wax a(0.5) | Wax b(1.5) | — | — | 145 | — | 122 | 58.1 |
| Comp. Ex. 4 | Resin A(25) | Resin K(25) | Resin C(50) | Wax f(0.5) | Wax b(1.5) | 31 | 20 | 143 | 119 | 120 | 48.6 |
| Comp. Ex. 5 | Resin A(25) | Resin E(25) | Resin C(50) | Wax a(0.5) | Wax b(1.5) | 3 | 48 | 145 | 147 | 122 | 45.6 |
| Comp. Ex. 6 | Resin A(25) | Resin F(25) | Resin C(50) | Wax c(0.5) | Wax b(1.5) | 12 | 39 | 134 | 138 | 111 | 46.2 |
| Comp. Ex. 7 | Resin A(25) | Resin D(25) | Resin C(50) | Wax g(0.5) | Wax b(1.5) | 27 | 24 | 150 | 123 | 127 | 45.3 |
| Comp. Ex. 8 | Resin A(25) | Resin K(25) | Resin C(50) | Wax d(0.5) | Wax b(1.5) | 31 | 20 | 137 | 119 | 114 | 46.5 |
| Comp. Ex. 9 | Resin A(25) | Resin E(25) | Resin C(50) | Wax g(0.5) | Wax b(1.5) | 3 | 48 | 150 | 147 | 127 | 49.1 |

TABLE 4-continued

| | Resin Binder | | | Wax | | Tm(R1) − Tm(R2) | Tm(R2) − Tm(R3) | Mp(W2) + 13 | Tm(R2) (° C.) | Mp(W2) − 10 | Content of Particles Having Particle Sizes of 3 μm or Less (% by number) |
|---|---|---|---|---|---|---|---|---|---|---|---|
| | Resin R1 | Resin R2 | Resin R3 | Wax W2 | Wax W3 | | | | | | |
| Comp. Ex. 10 | Resin A(25) | Resin D(25) | Resin C(50) | Wax h(0.5) | Wax b(1.5) | 27 | 24 | 130 | 123 | 107 | 47.6 |
| Comp. Ex. 11 | Resin A(25) | Resin F(25) | Resin C(50) | Wax i(0.5) | Wax b(1.5) | 12 | 39 | 156 | 138 | 133 | 47.1 |

Note)
Numerical values inside the parentheses are expressed by parts by weight, based on 100 parts by weight of the resin binder.

TABLE 5

| | Mixture Supplying Rate (kg/hr) | Mixture Supplying Rate Per Unit Cross-Sectional Area (kg/hr · cm$^2$) | Content of Particles Having Particle Sizes of 3 μm or Less (% by number) |
|---|---|---|---|
| Ex. 1 | 10 | 1.42 | 30.8 |
| Ex. 20 | 20 | 2.83 | 33.5 |
| Ex. 21 | 50 | 3.14 | 33.6 |
| Ex. 22 | 120 | 3.85 | 35.1 |

It can be seen from the above results that the toners of Examples 1 to 22 have lower contents as expressed by units of % by number of the particles having particle sizes of 3 μm or less of the finely pulverized product, as compared to those of Comparative Examples 1 to 11, so that toners have smaller amounts of fine powders. In addition, it can be seen from Table 5 that in cases where supplying rates of raw materials to the kneader are increased in order to increase productivity, the toners have lower contents as expressed by units of % by number of particles having particle sizes of 3 μm or less, so that the toners have smaller amounts of fine powders.

The toner obtainable by the method of the present invention can be suitably used in, for example, the development or the like of latent image formed in electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a toner comprising melt-kneading a mixture comprising a resin binder and a wax with a twin-screw kneader, wherein the resin binder comprises three kinds of a resin R1, a resin R2 and a resin R3 having different softening points from each other, wherein the resin R1 has a softening point Tm (R1) of from 145° to 160° C., the resin R2 has a softening point Tm (R2) of 122° C. or higher and lower than 145° C., and the resin R3 has a softening point Tm (R3) of 90° C. or higher and lower than 122° C., wherein the wax comprises at least two kinds of a wax W2 and a wax W3 having different melting points from each other, wherein the wax W2 has a melting point Mp (W2) of from 121° to 138° C., and the wax W3 has a melting point Mp (W3) of from 70° to 95° C., wherein Tm (R1), Tm (R2), Tm (R3) and Mp (W2) satisfy the formulas (I) to (3):

$$Tm(R1)-Tm(R2)>5 \quad (1)$$

$$Tm(R2)-Tm(R3)>20 \quad (2)$$

$$Mp(W2)+13>Tm(R2)>Mp(W2)-10 \quad (3)$$

and wherein the mixture is supplied to the twin-screw kneader in an amount of from 1.3 to 5.0 kg/hr·cm$^2$ per unit cross-sectional area of the screw, wherein each of the resin R1, the resin R2 and the resin R3 is an amorphous polyester.

2. The method for producing a toner according to claim 1, wherein Mp (W2) and Mp (W3) satisfy the formula (4):

$$Mp(W2)-(W3)>40 \quad (4).$$

3. The method for producing a toner according to claim 1, wherein the formula (3) is:

$$Mp(W2)+13>Tm(R2)>Mp(W2)-8.$$

4. The method for producing a toner according to claim 2, wherein the formula (4) is:

$$Mp(W2)-Mp(W3)>45.$$

5. The method for producing a toner according to claim 1, wherein the resin R2 has a softening point Tm (R2) of from 129° to 135° C.

6. The method for producing a toner according to claim 1, wherein the wax W2 has a melting point Mp (W2) of from 123° to 135° C.

7. The method for producing a toner according to claim 1, wherein the mixture is supplied to the twin-screw kneader in an amount of from 1.5 kg/hr·cm$^2$ or more and 4.5 kg/hr·cm$^2$ or less.

8. The method for producing a toner according to claim 1, wherein the amount of the resin R2 is from 5 to 50% by weight of the resin binder.

9. The method for producing a toner according to claim 1, wherein the amount of the wax W2 is from 0.1 to 10 parts by weight, based on 100 parts by weight of the resin binder.

10. The method for producing a toner according to claim 1, wherein the resin R1 and the resin R2 are in a weight ratio, i.e. the resin R1/the resin R2, of from 15/85 to 90/10.

11. The method for producing a toner according to claim 1, wherein the resin R2 and the resin R3 are in a weight ratio, i.e. the resin R2/the resin R3, of from 5/95 to 80/20.

12. The method for producing a toner according to claim 1, wherein a total amount of the resin R1 and the resin R3 and the resin R2 are in a weight ratio, i.e. (the resin R1+the resin R3)/the resin R2, of from 40/60 to 90/10.

13. The method for producing a toner according to claim 1, wherein the wax W2 and the wax W3 are in a weight ratio, i.e. the wax W2/the wax W3, of from 5/95 to 60/40.

14. The method for producing a toner according to claim 1, further comprising, subsequent to melt-kneading a mixture comprising a resin binder and a wax with a twin-screw kneader, pulverizing and classifying.

15. The method for producing a toner according to claim 1, wherein in the melt-kneading with a twin-screw kneader, the twin-screw kneader has a peripheral speed of screw rotation of from 0.1 to 1 m/sec.

16. The method for producing a toner according to claim 1, wherein in the melt-kneading with a twin-screw kneader, a barrel setting temperature is from 80° to 140° C.

17. The method for producing a toner according to claim 1, wherein the wax W2 is a polypropylene wax.

18. The method for producing a toner according to claim 1, wherein each of the amorphous polyesters is obtained by polycondensing an alcohol component comprising a dihydric or higher polyhydric alcohol and a carboxylic acid component comprising a dicarboxylic or higher polycarboxylic acid compound, wherein the alcohol component comprises an alkylene oxide adduct of bisphenol A represented by the formula (I):

(I)

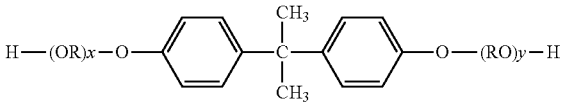

wherein RO and OR are an oxyalkylene group, wherein R is an ethylene and/or propylene group, x and y each shows the number of moles of the alkylene oxide added, each being a positive number, and the sum of x and y on average is from 1 to 16, in an amount of 50% by mol or more of the alcohol component.

19. A method for producing a toner comprising melt-kneading a mixture comprising a resin binder and a wax with a twin-screw kneader, wherein the resin binder comprises three kinds of a resin R1, a resin R2 and a resin R3 having different softening points from each other, wherein the resin R1 has a softening point Tm(R1) of from 148° to 158° C., the resin R2 has a softening point Tm(R2) of from 129° to 135° C., and the resin R3 has a softening point Tm(R3) of from 95° to 115° C., wherein the wax comprises at least two kinds of a wax W2 and a wax W3 having different melting points from each other, wherein the wax W2 has a melting point Mp(W2) of from 123° to 135° C., and the wax W3 has a melting point Mp(W3) of from 73° to 85° C., wherein Tm (R1), Tm (R2), Tm (R3), Mp (W2) and Mp (W3) satisfy the formulas (I) to (4):

$$Tm(R1)-Tm(R2)>5 \quad (1)$$

$$Tm(R2)-Tm(R3)>20 \quad (2)$$

$$Mp(W2)+10>Tm(R2)>Mp(W2)-8 \quad (3)$$

$$Mp(W2)-Mp(W3)>45, \quad (4)$$

and wherein the mixture is supplied to the twin-screw kneader in an amount of from 2.0 kg/hr·cm$^2$ or more and 4.0 kg/hr·cm$^2$ or less per unit cross-sectional area of the screw, wherein all of the resin R1, the resin R2 and the resin R3 are amorphous polyesters obtained by polycondensing an alcohol component comprising a dihydric or higher polyhydric alcohol and a carboxylic acid component comprising a dicarboxylic or higher polycarboxylic acid compound, wherein the alcohol component comprises an alkylene oxide adduct of bisphenol A represented by the formula (I):

(I)

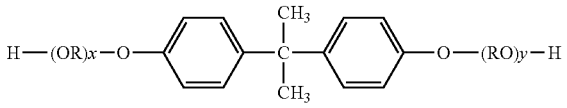

wherein RO and OR are an oxyalkylene group, wherein R is an ethylene and/or propylene group, x and y each shows the number of moles of the alkylene oxide added, each being a positive number, and the sum of x and y on average is from 1 to 16, in an amount of 50% by mol or more of the alcohol component, and wherein the wax W2 is a polypropylene wax, and the amount of the wax W2 is from 0.4 to 1.0 part by weight, based on 100 parts by weight of the resin binder, and wherein the wax W3 is a paraffin wax or a carnauba wax, and the amount of the wax W3 is from 1.2 to 2.0 parts by weight, based on 100 parts by weight of the resin binder, and wherein the amount of the resin R2 is from 25 to 30% by weight of the resin binder, and wherein the amount of the resin R1 is from 20 to 25% by weight of the resin binder, and wherein the amount of the resin R3 is from 50 to 55% by weight of the resin binder.

* * * * *